United States Patent [19]

Ely et al.

[11] 4,075,056

[45] Feb. 21, 1978

[54] PRESS SECTION STRUCTURE

[75] Inventors: Donald E. Ely, Roscoe, Ill.; Arnold J. Schmitt, Beloit, Wis.

[73] Assignee: Beloit Corporation, Beloit, Wis.

[21] Appl. No.: 775,572

[22] Filed: Mar. 8, 1977

Related U.S. Application Data

[63] Continuation of Ser. No. 497,722, Aug. 15, 1974, abandoned, which is a continuation of Ser. No. 407,574, Oct. 18, 1973, abandoned, which is a continuation-in-part of Ser. No. 115,235, Feb. 16, 1971, abandoned.

[51] Int. Cl.[2] ..... D21F 3/04; D21F 3/08

[52] U.S. Cl. ..... 162/305; 162/360 R

[58] Field of Search ..... 162/360 R, 358, 306, 162/305, 205; 100/121, 158, 162, 170, 176

[56] References Cited

U.S. PATENT DOCUMENTS 3,861,996 1/1975 Dorfel ..... 162/360 R

OTHER PUBLICATIONS

Kessler et al., "New Press Section . . . ," Paper Trade Journal; June 30, 1969; pp. 28 and 29.

*Primary Examiner*—Richard V. Fisher

*Attorney, Agent, or Firm*—Hill, Gross, Simpson, Van Santen, Steadman, Chiara & Simpson

[57] ABSTRACT

A paper machine arrangement for receiving a paper web from a forming wire and carrying the web through a plurality of press nips. A first felt picks up the web on the undersurface of the felt and carries the web through at least two press nips of a reverse press which includes an intermediate multi-compartment press roll and a first and second outer press roll forming first and second press nips with the intermediate roll. A second felt contacts the web prior to the reverse press and carries the web through the first press nip and the second felt is then guided downwardly away from the second outer press so that any broke can be dumped from the reverse press without shutting down the machine or accumulating the broke.

6 Claims, 4 Drawing Figures

W
209'
209
N-203
228
228a
F-204
209'
203a
209'
F-203
B
223
219
219
N-202
220
245
217c
217b
217a
218a
218
217
2156
N-201
209
F-202
F-201
215
215a
W
F-201
P
212
213
214
211
210
W

500
W
F-500
323
303a
W
319
B
300
N-302
345
317
F-301
N-301
F-302
318
F-302
315
F-301
314
W
311
310

PRESS SECTION STRUCTURE

CROSS REFERENCE TO RELATED APPLICATION

This application is a continuation of Ser. No. 497,722, filed Aug. 15, 1974 (now abandoned), which is a continuation of Ser. No. 407,574, filed Oct. 18, 1973 (now abandoned), which in turn is a continuation-in-part of Ser. No. 115,235, filed Feb. 16, 1971 (now abandoned).

BACKGROUND OF THE INVENTION

1. Field of the Invention

The invention relates to paper machine press sections and somewhat more particularly to an arrangement which conveys a new web from a forming surface to dewatering presses without any open draws and conveys the web through at least a reverse press in a completely supported manner and permits easy removal of broke.

2. Prior Art

Many paper machine felt transfer and press arrangements are known. However, with increased modern-day high capacity paper machines capable of running at speeds in excess of 3000 to 7000 feet per minute, these known arrangements exhibit various drawbacks, such as insufficient web support, excessive wrap about one or more guide or press rolls, improper press roll alignment for proper web travel, insufficient dewatering capacity, excessive machine space requirements, excessive felt length requirements, etc.

For example, U.S. Pat. No. 2,204,446 illustrates forms of prior art felt transfer and press arrangements wherein the felt and press rolls are so arranged to cause the wire-side of the web to contact a plain press roll and thereby eliminate wire markings on the web. However, the travel path of the felt-supported web through the press nips involves a number of sharp turns which are detrimental at high speeds and improper felt and press roll arrangement in this system limits the dewatering capacity of the arrangement.

U.S. Pat. No. 2,764,068 illustrates another form of prior art felt transfer and press arrangement wherein the felts and press rolls are arranged, along with a movable doctor, to dump a portion of the broke from the arrangement during start-up procedures. However, improper roll sequence at the first press nip prevents the web from reliably following its intended path of travel and improper felt guidance over certain of the press rolls causes excessive re-wetting thereof which leads to operational difficulties. Further, the doctor arrangement makes it extremely difficult to re-thread the arrangement with a full width sheet (web) and this arrangement is not suitable for modern-day high speed paper machines.

Other prior art felt transfer and press arrangements are also known, for example, typical prior art arrangements are shown in U.S. Pat. Nos. 1,930,104; 2,386,584; 3,198,696; 3,268,390; 3,515,637; 3,355,350; 3,595,745; etc. These arrangements have one or more of the drawbacks set forth above, especially when combined with high speed paper machines.

SUMMARY OF THE INVENTION

The invention provides an improved felt transfer and press arrangement useful with high speed paper machines. The arrangement of the invention includes a first felt which picks up a web from a forming wire and conveys the web through at least two nips of a reverse press and a second felt which sandwiches the web with the first felt and conveys the web through the first nip of a reverse press and is then guided away from the web so that any broke can be directly dumped from the arrangement without requiring machine shutdown or movement of any machine components.

It is a novel feature of the invention to include a reverse press arrangement having rolls arranged to minimize machine space requirements. The arrangement includes an outer grooved press roll, an intermediate multi-compartment suction press roll and an outer plain press roll. Additional press nips may be provided in further combinations with the plain press roll and the overall arrangement is suitable for further modification by including further press sections and other auxiliary equipment.

In one embodiment of the invention, a steam jet is directed against the web as it travels over a suction compartment of the intermediate multi-compartment suction roll for improved dewatering.

DESCRIPTION OF THE PREFERRED EMBODIMENTS

Figure 1:
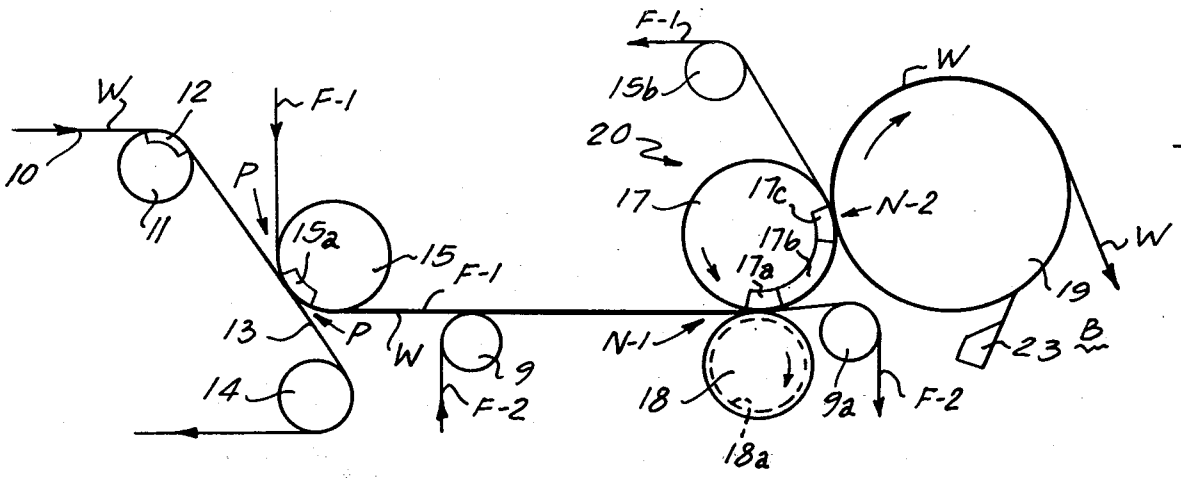
FIG. 1 is a schematic side elevational view showing a basic felt transfer and press arrangement constructed in accordance with the principles of the invention.

The structural elements of a paper machine embodying the principles of the present invention are shown schematically as has grown customary in the paper machine patent art and mechanical expedients for supporting and driving the rolls and accompanying machinery will be fully apparent to those versed in the paper making art, to which the present invention pertains. In the description and claims which follow, reference is made to on-coming or upstream and off-running or downstream directions and it will be understood that reference is made to machine direction, which in the drawings runs from right to left.

The invention provides a felt transfer and press arrangement for light and heavy webs or sheets allowing them to be transferred at high speeds from forming wires, such as Fourdrinier wires or other forming wires, for example, as shown in Parker et al U.S. Pat. No. 3,726,758 to felts and be conveyed through compact press sections for maximum dewatering. The invention also allows any broke to be quickly removed from the arrangement without machine shutdown, accumulation of broke or any special movement of machine elements.

In a paper machine such as partially shown at FIG. 1, a web W is formed on an endless traveling Fourdrinier wire 10 which passes over a couch roll 11 having a suction gland 12 therein. The wire 10 is guided downwardly to define a pick-up run 13 and around a turning roll 14 back to a headbox slide outlet (not shown). The pick-up run 13 is preferably angled about 30° to 60° in upward or downward direction so that the direction of web travel does not change excessively as it is removed from the wire at a pick-up nip P.

The pick-up nip P is defined by an endless looped first felt F-1 traveling over a pick-up roll 15 having a suction gland 15*a* therein and in close running relation with the web W on the wire 10 along the pickup run 13. The relatively moist web (about 20% bone dry) contacts the relatively sold felt F-1 and is removed from the relatively porous wire 10. The suction from gland 15*a* causes the web to adhere to the exposed undersurface of felt F-1 and travel therewith along the generally horizontal run shown, although this run may be slightly inclined or declined, depending on the position of subsequent press rolls and other machine elements of a paper machine.

The endless looped felts, as they are described, comprise felt loops trained over a plurality of guide and stretcher rolls and are arranged for receiving water from the web. After the web is removed from a felt, it passes through suitable felt conditioning, cleansing and drying means of the type well-known to those versed in the art and, accordingly, which are not shown herein.

As the web travels with the felt F-1 and in contact with the outer surface of the felt F-1, a second felt F-2 is brought up beneath the web W and into supporting contact with the web by a guide roll 9. The web W is thus sandwiched between the felts F-1 and F-2 as it travels into a reverse press 20. The second felt F-2 provides additional water-receiving means and aids in handling heavier webs so as to prevent such webs from separating from the under or outer surface of felt F-1. In certain embodiments, the second felt F-2 may be heated prior to contact with the web to render the felt more water receptive and improve the transfer of water from the web to the felt. Typically, the felts F-1 and F-2 are of a felt weight in the range of about 2 to 5 ounces per square foot.

The web W is sandwiched between the felts F-1 and F-2 and is carried thereby into a first press nip N-1 of a reverse press 20. The reverse press comprises an intermediate multi-compartment suction press roll 17, an outer grooved roll 18 and an outer plain roll 19. The suction roll 17 preferably has three successive suction compartments, with the two outer compartments being of a relatively small size and having higher vacuum than the intermediate compartment. The plain press roll 19 is of a larger diameter than either the grooved roll 18 or the suction roll 17 and has a smooth polished outer surface of metal or granite so that the web will tend to adhere to its smooth surface. Rolls 17 and 18 define a first press nip N-1 and rolls 17 and 19 define a second press nip N-2. The rolls of the reverse press are arranged to minimize machine space requirements and to insure that the press nips thereof are spaced apart to minimize the danger of broke or the like becoming fouled up in both nips. As shown, the rolls 17-19 are arranged so that the outer rolls are spaced apart about the intermediate roll and so that the first nip N-1 is horizontal while the second nip N-2 is vertical. In the preferred arrangements, grooved roll 18 contacts the suction roll 17 at its first suction compartment and the second outer roll 19 contacts roll 17 at its last suction compartment.

In the first press nip N-1, the web is pressed between the felts F-1 and F-2 and water within the web migrates into the felts and the press roll. A majority of the water will migrate downwardly into felt F-2 and grooved roll 18, which is preferably the type described in Justus U.S. Pat. No. 3,198,697 and some water will migrate upwardly, into felt F-1 and suction roll 17. The suction roll 17 is formed of a perforated roll shell and provided with three successive suction glands 17*a* through 17*c*. The outer glands 17*a* and 17*b* are preferably relatively small and are provided with relatively high vacuum while gland 17*c* is relatively large and is provided with relatively low vacuum. As the sandwiched felt-web-felt structure passes beyond the nip N-1, the felt F-2 is guided by guide roll 9*a* so as to slightly wrap the periphery of suction roll 17 and is then guided downwardly and away from the reverse press 20 through its endless loop. The felt F-2 wraps the roll 17 for about 1° to 10° and preferably about 5° to 10°. This effectively prevents re-wetting of the felt F-2 by the water being thrown from the grooves 18*a* of grooved roll 18. Because of the suction in gland 17*a*, the now partially dried web (about 32% bone dry) remains in contact with the felt F-1 and travels around suction roll 17, past suction gland 17*b* and into the second press nip N-2. As the web travels by the suction gland 17*b*, air is drawn through the web into the gland to further dry the web and prevent any water within the felt F-1 from flowing outwardly to rewet the web.

The web W is then passed through the second press nip N-2 where additional water is removed. On the off-running side of the press nip N-2, the felt F-1 is guided by a guide roll 15*b* to wrap the suction roll 17 for a distance extending to at least the off-running side of suction gland 17*c* to minimize rewetting problems and to insure that air will be able to get at the off-running edge of gland 17*c* to break the vacuum and allow the web to adhere to the smooth surface of the relatively large diametered plain press roll 19.

The web W is carried on a surface of the plain roll 19 for a distance of about 180° and then received by a means (not shown) for further processing as required. Such means may comprise a dryer section or a further press section such as disclosed hereinafter.

The felts passing through the reverse press 20, i.e. F-1 and F-2, as well as the rolls thereof are arranged to provide an unobstructed open space B which extends at least below roll 19 and allows any broke to be dumped below the press 20 without shut-down and without moving any machine elements or accumulation of all or a portion of the broke. A doctor blade 23 is provided in working relation with the down-running surface of the plain press roll 19 and prevents the web from following around the roll 19, which would cause operational problems. The doctor blade separates any broke from the surface of the roll in the event of web breakage and dumps it into the open space B. It will be appreciated that a high machine speeds a considerable volume of broke accumulates in a relatively short time period and that considerable time may be required to correct the problem which caused the broke and to re-thread the web. The felt and press arrangements of the invention allow any desired amount of broke or the like to be quickly and permanently removed from the paper machine.

Figure 2:
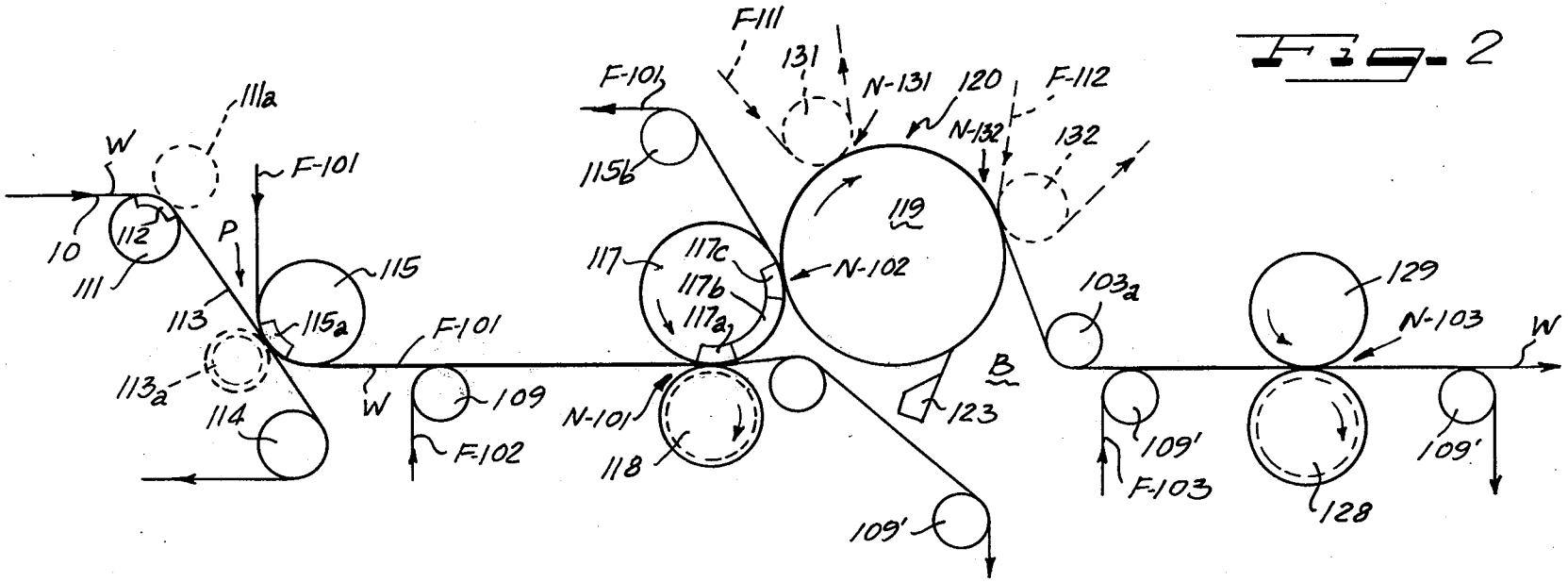
FIG. 2 is a somewhat similar view of a modified arrangement embodying the principles of the invention.

In the arrangement shown at FIG. 2, like elements are designated with reference characters similar to such elements in FIG. 1, except that they are in the 100 series. A web W is carried on a Fourdrinier forming wire 110 which passes over a couch roll 111 having a suction gland 112. Optionally, as shown in phantom, a couch presser roll or "lump-breaker" roll 111*a* may be positioned above the suction gland 112 of couch roll 111. The couch presser roll 111*a* aids in sealing the newly formed web or sheet to the couch which reduces leakage and thus raises the vacuum and increases the amount of water removed at the couch. Roll 111*a*, when utilized, also increases sheet consolidation, reduces the number of lumps and reduces the incidence of wet-end breaks. It may also be advantageous to provide a very fine spray above roll 111*a* to minimize the danger of the web wrapping this roll.

The wire 110 carries the web W past the couch roll 111 and through a pick-up run 113, which extends angularly downwardly as explained in the discussion relating to FIG. 1. The wire is then guided by turning roll 114 back through its loop. The web W is transferred from the wire 110 along pick-up run 113 at a pick-up nip P by a first felt F-101. The felt F-101 is guided into close running web transfer relation with the wire by a pick-up roll 115, which has a suction gland 116 opposite the pick-up nip P to cause the web to follow the felt F-100 and travel with the felt along a horizontal run leading into a multi-nip reverse press 120.

A support roll 113*a*, such as shown in Cronin U.S. Pat. No. 3,595,745, may optionally be positioned opposite the pick-up nip P inside the wire 110 for improved transfer of the web to the felt F-110.

As the web is carried along the horizontal run of felt F-101, a second felt F-102 travels over a guide roll 109 and into supporting contact with the web so as to sandwich the web between the felts F-101 and F-102.

The basic arrangement of the multi-nip reverse press 120 is similar to that of press 20 in FIG. 1 and reference is made to that discussion for further details. Press 120 is, optionally, provided with further press nips N-131 and N-132, as shown in phantom. Nip N-131 is defined by a press roll 131 and carries a felt F-111 into pressing relation with the web W on the outer surface of plain press roll 119. Similarly, nip N-132 is defined by a press roll 132 and cooperating felt F-112. The press rolls 131 and 132 may be identical or different and further details of such arrangements may be found in Schmitt U.S. Ser. No. 312,658, filed Dec. 6, 1972, now abandoned, which is owned by the instant assignee and incorporated herein by reference. These further press nips provide additional dewatering capacities, as required by heavier weight webs.

The web is thus carried through successive felt-protected press nips in the multi-nip press 120 and gains sufficient strength to be self-supporting so as to pass through an open draw, as after removal from plain press roll 119. A draw roll 103*a* is positioned to contact the web as an aid in preventing undue fluttering or the like by the web in the open draw area. In the embodiment here shown, a third felt F-103 is guided by a guide roll 109' into supporting contact with the web to carry it through a third press nip N-103 defined by a plain press roll 129 and a grooved press roll 128. Thereafter, the web continues traveling to further processing stations as required.

Figure 3:
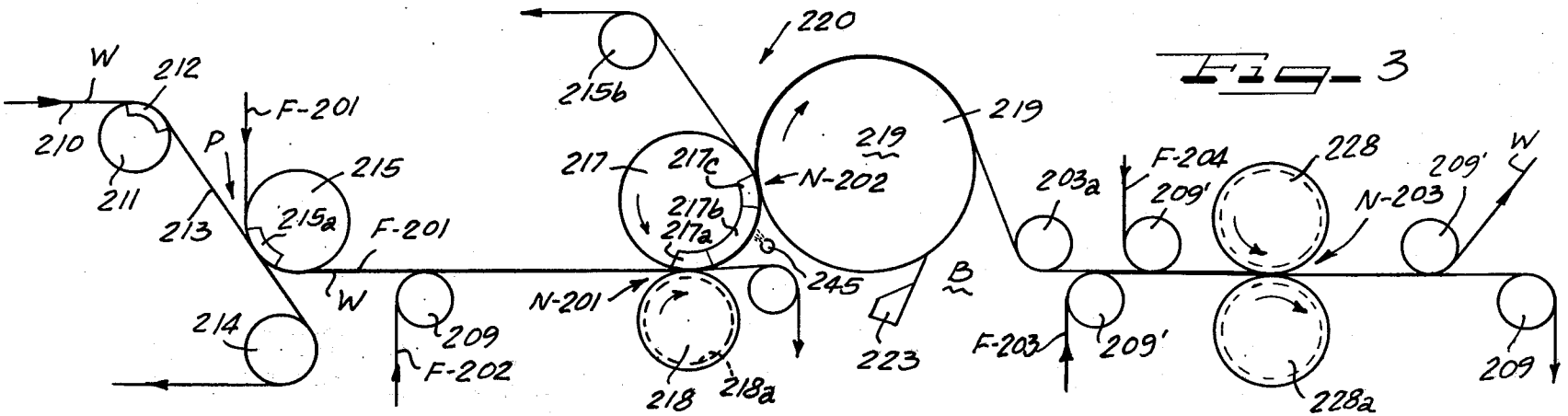
FIG. 3 is a schematic side elevational view showing another arrangement embodying the principles of the invention.

The arrangement shown at FIG. 3 is similar to those shown at FIGS. 1 and 2 and elements of FIG. 3 are given reference characters similar to like elements in the earlier figures, but in the 200 series. Thus, a wire 210 is arranged to carry a web W over a suction couch roll 212 and downwardly along a pick-up run 213. A first felt F-201 is arranged to pass over a suction pick-up roll 215 and pick off the web from the wire at the pick-up nip P. The web is then carried by felts F-201 and F-202 into a reverse press 220, which is similar to the reverse presses discussed earlier.

In the arrangement shown at FIG. 3, a steam jet means 245 is positioned opposite the intermediate suction gland 217*b* of multi-component suction roll 217. Live steam from a suitable source (not shown) is fed through the jet means 245 to impinge against the web as it passes over gland 217*b* and raise the temperature of the moisture therein, reducing its viscosity and rendering it more susceptible to withdrawal from the web by the suction of glands 217*b* and 217*c*. The web then continues traveling and passes through nip N-202 where additional dewatering takes place. The rolls and felts of this arrangement are so arranged that should web breakage occur, the broke can readily be dumped to a basement via open broke space B.

After traveling over a portion of the plain press roll 119, the web gains sufficient body or strength to pass across an open draw and onto a third felt F-203. A draw roll 203*a* is positioned to provide a point of support for the web so as to minimize fluttering of the web as it travels across the open draw. A felt F-204 is guided into working relation with felt F-203 to sandwich the web therebetween and protect it as it passes through a further dewatering nip N-203. A pair of grooved rolls 228 and 228*a* define the nip N-203 and remove further amounts of water from the web. On the off-running side of nip N-203, the felts F-203 and F-204 are guided away from the web and through their respective loops. A means (not shown) receives the web from the off-running side of the nip N-203 for further processing as required.

Figure 4:
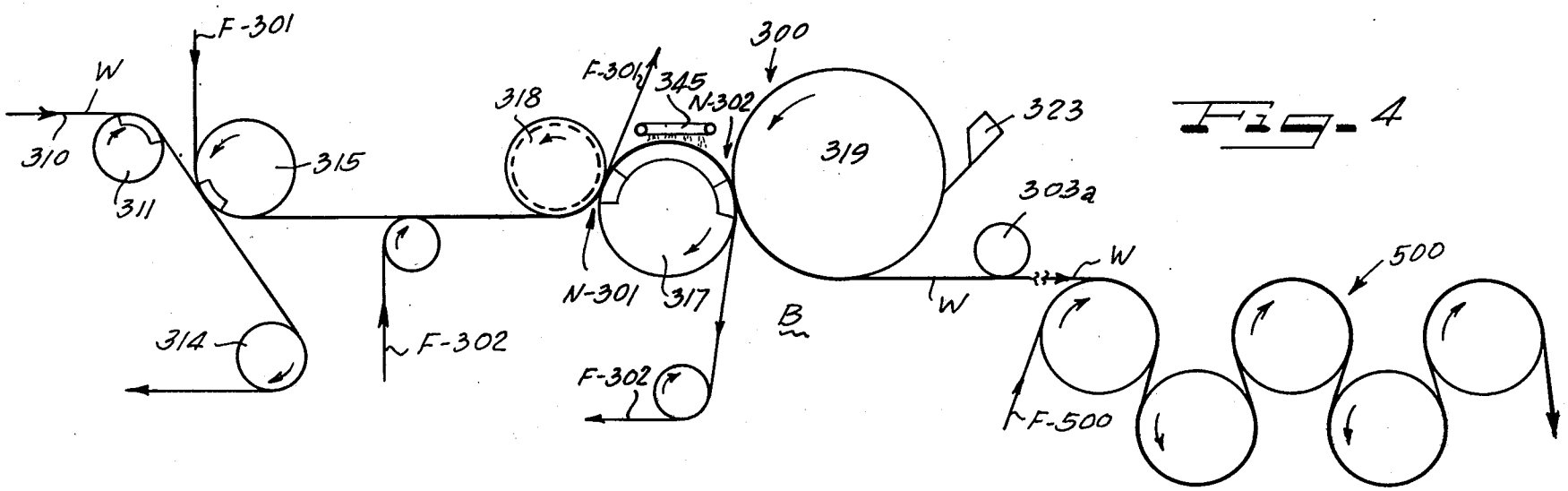
FIG. 4 is a somewhat similar view of yet another arrangement embodying the principles of the invention.

The arrangement of FIG. 4 is quite similar to that of FIG. 1 and like elements have been given like reference characters in the 300 series. The web path of travel and machine elements acting thereon are essentially similar to those discussed earlier so that detailed discussion will be omitted. A unique feature resides in the arrangement of the reverse press 300. The press rolls 318, 317 and 319 are aligned horizontally so that the press nips N-301 and N-302 are spaced apart about 180° and are vertically disposed. The horizontal disposition of the press rolls lessens the press room height requirements and minimizes the weight carried by roll 318 so as to allow better control of the nip pressures applied at N-301 and N-302. While pressure adjustment means have not been shown, such means are known in paper machine presses for regulating the amount of pressure applied by cooperating rolls on a web or felt in a press nip.

On the off-running side of the press nip N-302, an open space B is provided and preferably leads to the basement of a paper machine mill for ready accommodation of broke. At high rates of speed employed by present-day paper machines, a sudden collection of tremendous volumes of broke occur with the breakage of a web or at start-up and can cause serious damage to machines and personnel. The open space B provided by the arrangements of the invention insure that any volume of broke will be immediately removed from the machine and will not pile up between nips or on felts as was likely to occur with arrangements heretofore available.

Following the nip N-302, a web is about 40% bone-dry and is sufficiently strong to cross an open draw without support and be guided to, for example, a serpentine dryer section 500 wherein a dryer felt F-100 is trained to pass around the individual dryer drums and alternatively separate the web from the surface of a drum and urge the web into direct contact with the surface of a drum so as to effect complete drying of the web.

As is apparent from the foregoing specification, the present invention is susceptible of being embodied with various alternations and modifications which may differ particularly from those that have been described in the preceding specification and description. For this reason, it is to be fully understood that all of the foregoing is intended to be merely illustrative and is not to be construed or interpreted as being restrictive or otherwise limiting of the present invention, excepting as it is set forth and defined in the hereto-appendant claims.

I claim as my invention:

1. A press mechanism for removing water from a traveling fibrous web formed on a forming section of a machine comprising in combination:

first and second rolls defining a first press nip therebetween;

a third press roll forming a second nip with the first roll;

a fourth press roll forming a third nip with the third press roll;

a web carrying first felt receiving the web from the forming section and passing through the first nip following the first roll and thereafter passing through the second nip separating from the web after the second nip with the web following the third roll after said second nip to pass through the third nip;

a second felt passing through the first nip on the side of the web opposite said first felt so that the web is initially dewatered in both directions; and a third felt passing through said third nip with the web, said web passing sequentially through said first, second, and third nips being supported continually between nips.

2. A press mechanism for removing water from a traveling fibrous web formed on a forming section of a machine constructed in accordance with claim 1:

wherein said first and second rolls are substantially in vertical alignment and said first felt travels in substantially a horizontal path from the location of receiving the web through the first nip.

3. A press mechanism for removing water from a traveling fibrous web formed on a forming section of a machine constructed in accordance with claim 1:

wherein said first roll is a suction roll; and a suction gland is included within the first roll extending between the first and second nips.

4. A press mechanism for removing water from a traveling fibrous web formed on a forming section of a machine constructed in accordance with claim 1:

wherein said first press roll is a vented roll.

5. A press mechanism for removing wate from a traveling fibrous web formed on a forming section of a machine constructed in accordance with claim 1:

wherein said first roll is a suction roll and a suction gland is positioned opposite said first nip, and said second roll contains grooves in the outer peripheral surface.

6. A press mechanism for removing water from a traveling fibrous web formed on a forming section of a machine constructed in accordance with claim 1:

wherein said third roll is a plain roll with a smooth outer surface.

* * * * *